US012102881B2

(12) United States Patent
Eisenhardt et al.

(10) Patent No.: US 12,102,881 B2
(45) Date of Patent: Oct. 1, 2024

(54) SWIMMING GOGGLES WITH INTEGRATED GLASS

(71) Applicant: Form Athletica Inc., Vancouver (CA)

(72) Inventors: Dan Eisenhardt, Vancouver (CA); Adam Capelin, Vancouver (CA); Derek Disanjh, Vancouver (CA)

(73) Assignee: Form Athletica Inc., Vancouver (CA)

( * ) Notice: Subject to any disclaimer, the term of this patent is extended or adjusted under 35 U.S.C. 154(b) by 248 days.

(21) Appl. No.: 17/455,413

(22) Filed: Nov. 17, 2021

(65) Prior Publication Data

US 2022/0152458 A1 May 19, 2022

Related U.S. Application Data

(60) Provisional application No. 63/198,867, filed on Nov. 18, 2020.

(51) Int. Cl.
*A63B 33/00* (2006.01)

(52) U.S. Cl.
CPC ..... *A63B 33/004* (2020.08)

(58) Field of Classification Search
CPC ..... A63B 33/002; A63B 33/004
See application file for complete search history.

(56) References Cited

U.S. PATENT DOCUMENTS

| | | | | |
|---|---|---|---|---|
| 3,944,345 | A * | 3/1976 | Decorato | G02C 1/00 2/447 |
| 5,802,620 | A * | 9/1998 | Chiang | A63B 33/004 2/452 |
| 6,676,257 | B2 * | 1/2004 | Sheldon | B63C 11/12 351/49 |
| 6,810,536 | B2 * | 11/2004 | Yamamoto | A63B 33/004 2/428 |
| 7,290,294 | B2 * | 11/2007 | Kita | A61F 9/025 2/443 |
| 9,120,951 | B2 * | 9/2015 | You | G02B 1/043 |
| 9,833,663 | B2 * | 12/2017 | DiChiara | G02C 13/00 |
| 10,698,219 | B1 | 6/2020 | Eisenhardt et al. | |
| 2004/0111788 | A1 * | 6/2004 | Chou | A63B 33/004 2/426 |
| 2005/0128426 | A1 * | 6/2005 | Shiue | A63B 33/004 351/43 |
| 2006/0242745 | A1 * | 11/2006 | DiChiara | A63B 33/004 2/12 |
| 2019/0269968 | A1 | 9/2019 | Eisenhardt et al. | |
| 2021/0362007 | A1 * | 11/2021 | Stephens | G02C 11/08 |

* cited by examiner

*Primary Examiner* — F Griffin Hall
(74) *Attorney, Agent, or Firm* — Borden Ladner Gervais LLP; Richard A. Johnson

(57) ABSTRACT

The present disclosure provides a pair of swimming goggles comprising a glass insert in each goggle lens. Each goggle lens comprises a body constructed form a substrate material and a glass insert received within a lip extending upwardly from around the perimeter of the body. The glass insert may be installed on top of a coating on a substrate material of the goggle lens. The glass insert may comprise a glass plate having an adhesive sheet on an underside thereof.

9 Claims, 5 Drawing Sheets

SWIMMING GOGGLES WITH INTEGRATED GLASS

CROSS REFERENCE TO RELATED APPLICATION

This application claims the benefit of priority of U.S. Provisional Patent Application No. 63/198,867 filed Nov. 18, 2020, which is hereby incorporated herein by reference in its entirety.

TECHNICAL FIELD

The present disclosure relates to swimming goggles.

BACKGROUND

Swimming goggles can become worn out over time in a number of ways. For example, straps can lose elasticity, seals can break down, and lenses can become scratched.

The inventors have determined a need for swimming goggles with improved durability.

SUMMARY

One aspect provides a pair of swimming goggles comprising a glass insert in each goggle lens. The glass insert is received within a lip extending upwardly from around the perimeter of the body. In some embodiments the glass insert may be installed on top of a mirror coating or other coating on a substrate material of the goggle lens. The glass insert may comprise a glass plate having an adhesive sheet on an underside thereof.

Further aspects of the present disclosure and details of example embodiments are set forth below.

DRAWINGS

The following figures set forth embodiments in which like reference numerals denote like parts. Embodiments are illustrated by way of example and not by way of limitation in the accompanying figures.

DETAILED DESCRIPTION

Figure 1:
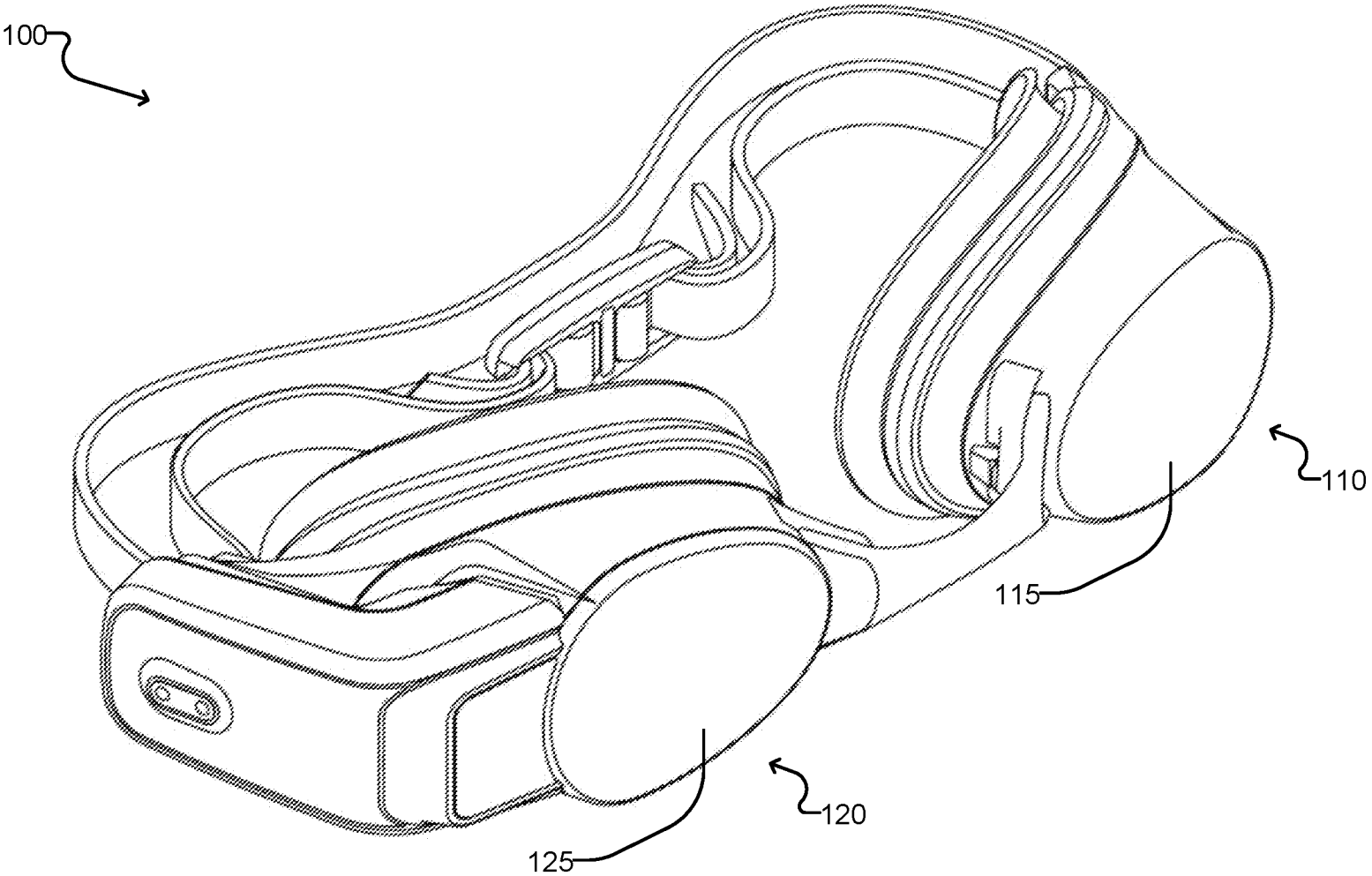
FIG. 1 shows a pair of swimming goggles with an integrated heads-up display (HUD) system.

The following describes examples of swimming goggles with glass inserts integrated into the goggle lenses. The purpose of the glass inserts is to provide superior scratch resistance due to their hardness. The glass insert is installed over top of a substrate from which a goggle lens is created. Goggle lens substrates are typically made from a clear material and molded with a color tint (e.g. smoke, blue, red, yellow, etc.), which is embedded in the raw clear material prior to molding. In some embodiments, the glass insert is installed directly on the substrate material. In some embodiments, a coating (e.g. a mirror coating) is optionally applied to the substrate after molding, and the glass insert is installed over the coating. In contrast to typical eyewear hardcoatings, wherein coatings (mirror coatings or other types of coatings) are processed last, over the top of the hardcoat, to prevent the coating(s) from cracking when the hardcoat is thermally cured, in embodiments where one or more coating is applied to the substrate material of goggle lenses, the glass inserts disclosed herein not only provide improved scratch resistance and protect the underlying substrate, but also provide protection for the coating(s).

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

FIG. 1 shows an example pair of goggles 100 with two eyecups 110 and 120 having glass inserts 115 and 125 integrated therein according to one embodiment of the present disclosure. The goggles 100 shown in FIG. 1 have a heads up display (HUD), and have the same aesthetic features as disclosed in International Registration Number DM/202 296. However, it is to be understood that the glass inserts and related methods disclosed herein could be incorporated into and used in conjunction with goggles with different designs. In some embodiments, the goggles 100 may have a HUD with the same or similar features as disclosed in U.S. Pat. No. 10,698,219 and/or U.S. Patent Application Publication No. 2019/0269968, both of which are hereby incorporated by reference herein. However, it is to be understood that the glass inserts and related methods disclosed herein could be incorporated into and used in conjunction with goggles without HUDs, or with differently configured HUDs. As described further below, the glass inserts 115 and 125 protect the substrate material forming the majority of eyecups 110 and 120 (as well as any coating(s) applied thereto), and provide increased scratch resistance.

Figure 2A:
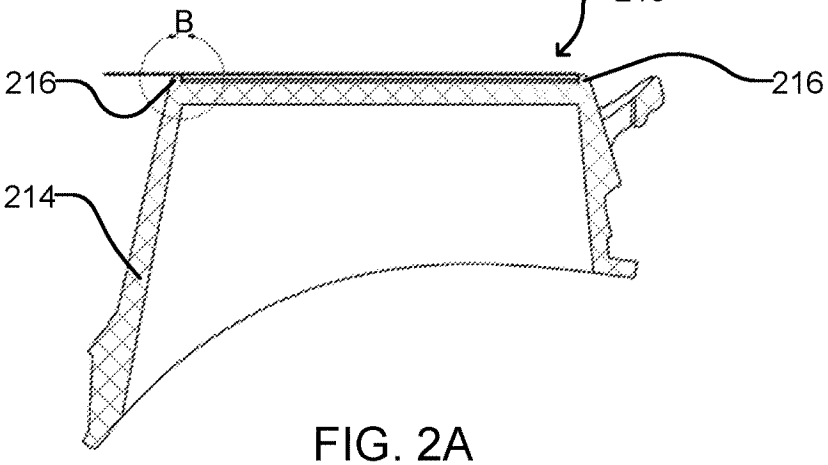
FIG. 2A is a sectional view through line A-A of FIG. 2.
Figure 2C:
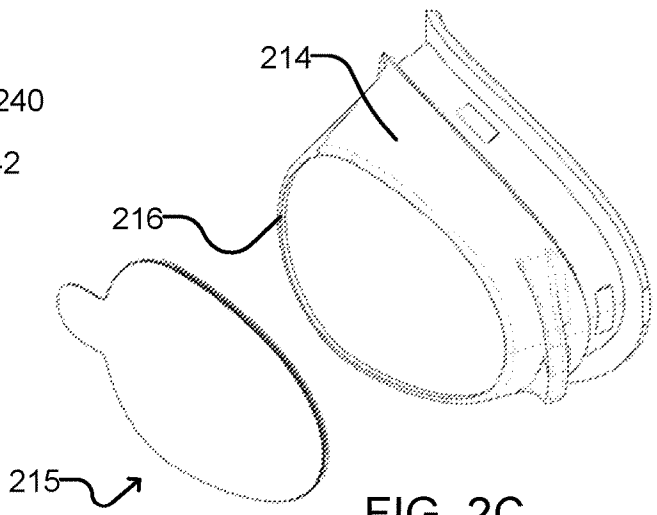
FIG. 2C shows the eyecup and glass insert of FIG. 2 prior to installation of the glass insert according to an example method of the present disclosure.
Figure 2:
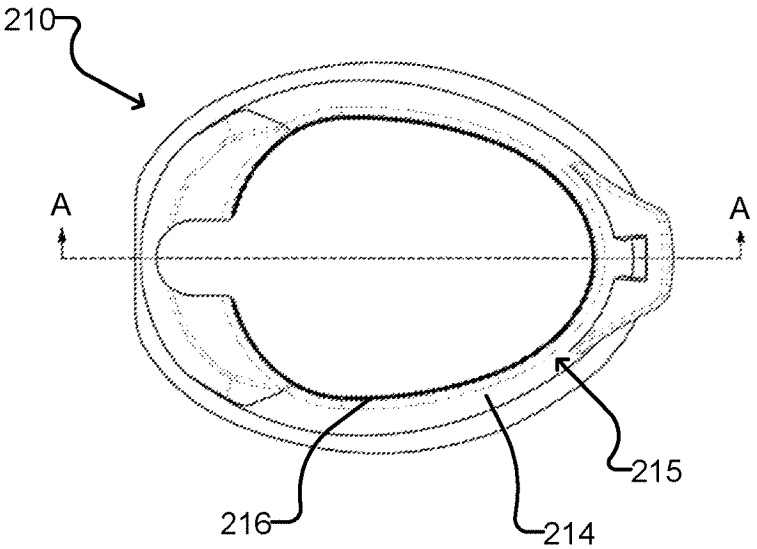
FIG. 2 shows an example eyecup of a pair of swimming goggles according to one embodiment of the present disclosure.

FIGS. 2-2C show an example eyecup 210 of a swimming goggle lens adapted for receiving a glass insert 215 comprising a glass plate 240 according to one embodiment of the present disclosure. The eyecup 210 comprises a body 214 of a polycarbonate material, and has a lip 216 extending upwardly (the term "upward" and related directional terms used herein refer to the direction farther from a user's eye when the goggles are worn) from around the perimeter of the lens sized to receive the glass insert 215 and protect the edge of the glass plate 240. The lip 216 also provides registration for assembly to ensure proper placement of the glass insert 215.

Figure 3A:
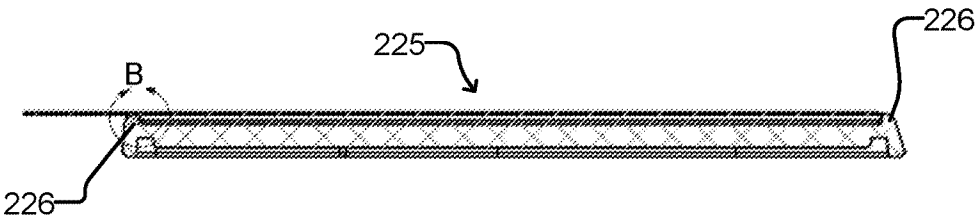
FIG. 3A is a sectional view through line A-A of FIG. 3.
Figure 3C:
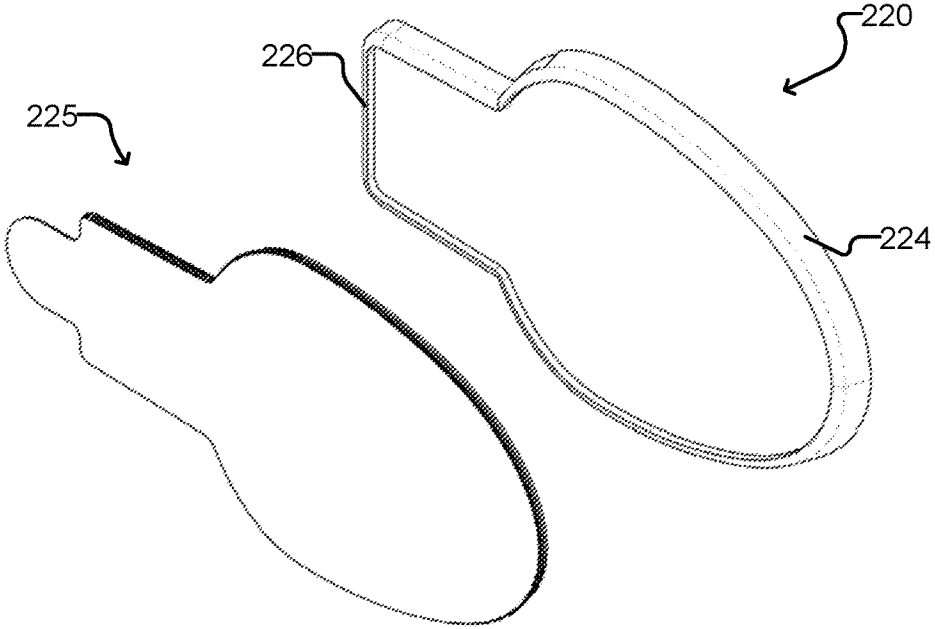
FIG. 3C shows the cap and glass insert of FIG. 3 prior to installation of the glass insert according to an example method of the present disclosure.
Figure 3:
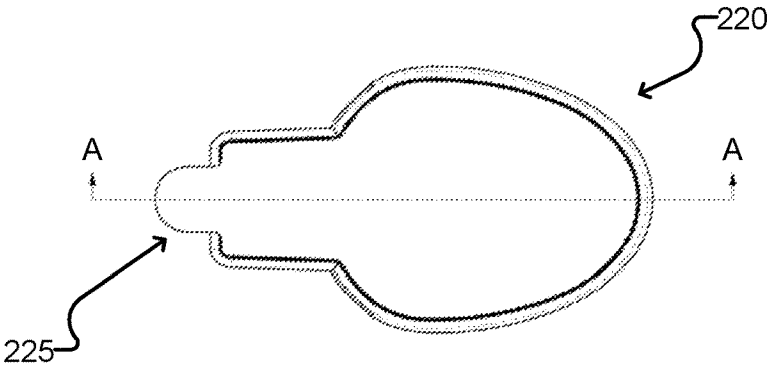
FIG. 3 shows an example cap for an optics module of a pair of swimming goggles with an integrated HUD system according to another embodiment of the present disclosure.

FIGS. 3-3C show a lens cap 220 adapted for receiving a glass insert 225 according to one embodiment of the present disclosure. In the illustrated example, the lens cap 220 is configured as part of an optics module of a HUD integrated into a swimming goggle lens of the type disclosed in U.S. Pat. No. 10,698,219, but it is to be understood that inserts similar to glass insert 225 may be adapted for use with other types of goggle lenses with differently shaped elements. Similar to the eyecup 210 of FIGS. 2-2C, the cap 220 of FIGS. 3-3C comprises a body 224 of a polycarbonate material, and has a lip 226 extending upwardly from around the perimeter thereof sized to receive the glass insert 225 and protect the edge of the glass plate 240. The lip 226 also provides registration during assembly.

The glass inserts 215/225 each comprise a glass plate 240, as well as one or more layers of adhesive for securing the glass plate 240 to the polycarbonate material of the cup/cap body 214/224. In the illustrated examples, the glass plate 240 is generally planar. In other embodiments, glass inserts comprising non-planar (e.g. curved) glass plates may be provided, depending on the design of the goggles with which the inserts are to be used. Further details of example glass inserts are discussed below with reference to FIG. 4.

Figure 2B:
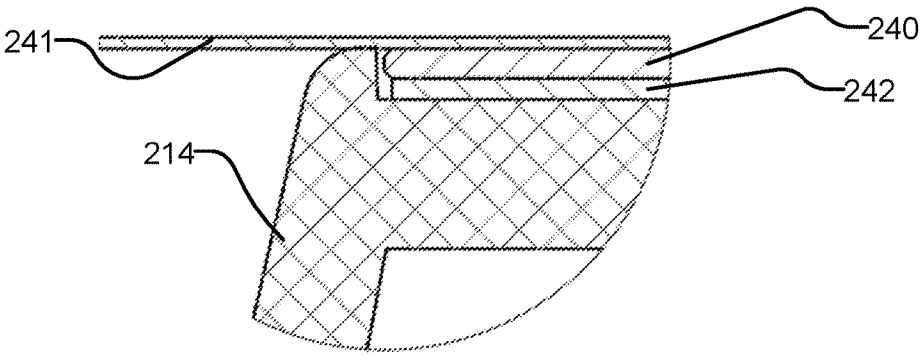
FIG. 2B is an enlarged view of the area in circle B of FIG. 2A.
Figure 3B:
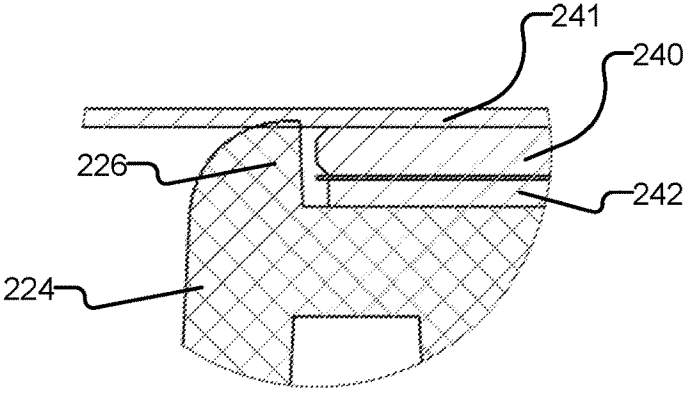
FIG. 3B is an enlarged view of the area in circle B of FIG. 3A.

In some embodiments, glass inserts may be manually inserted into swimming goggles. For example, as best seen in FIGS. 2B and 3B, in some embodiments a removable protective cover 241 is provided atop the glass plate 240, to facilitate installation. The insert 215/225 may be pressed against the body 214/224, such that the adhesive(s) on the underside of the glass bond to the polycarbonate material, then the cover 241 may be removed. The cover 241 protects the glass plate 240 during installation. In some embodiments, the glass plate 240 may optionally be covered with one or more coatings, such as for example an anti-fingerprint hydrophobic or oleophobic coating. Other optical coatings are also possible, including without limitation anti-reflection coatings, anti-glare coatings, and anti-microbial coatings.

In other embodiments, glass inserts may be installed without adhesives, for example by glass insert moulding during the polycarbonate goggle lens moulding. Such a process would permanently bond the glass to the polycarbonate substrate.

Figure 4:
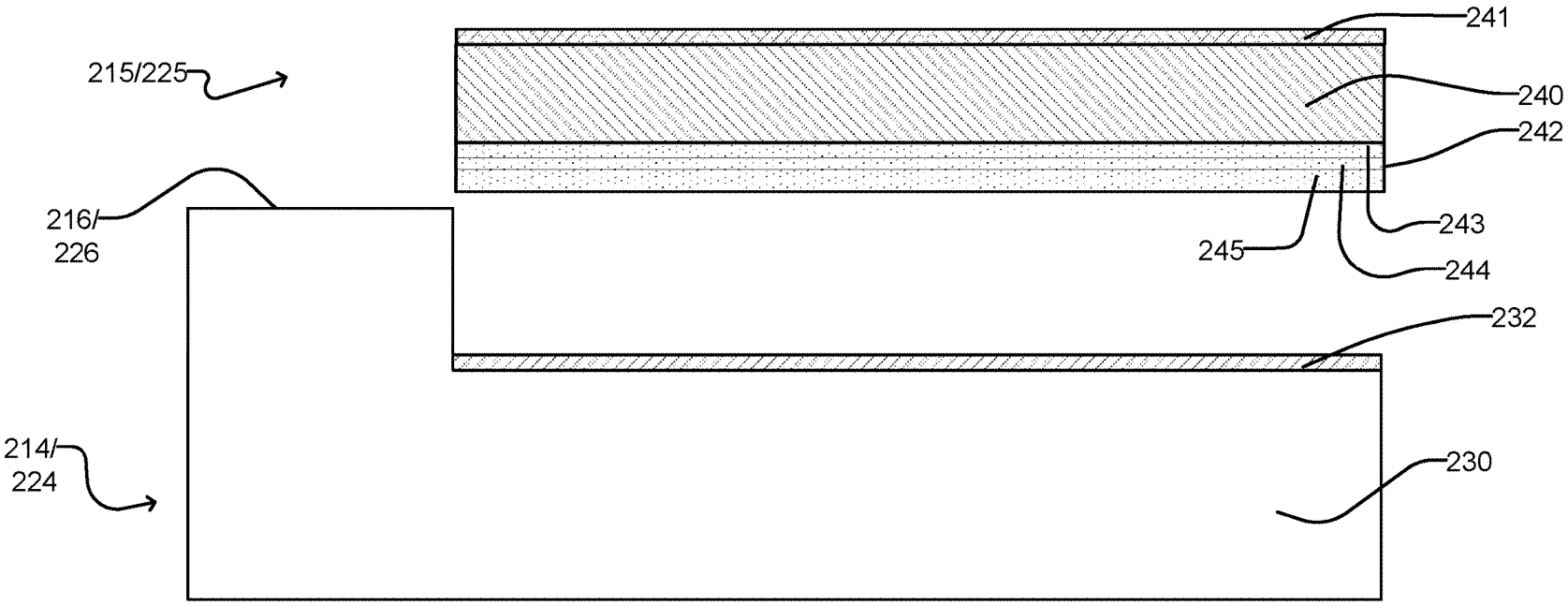
FIG. 4 shows a sectional view through portions of a swimming goggle lens and glass insert to be installed therein according to one embodiment of the present disclosure.

FIG. 4 shows a sectional view through portions of a swimming goggle lens, such as for example the body 214/224 of the cup/cap 210/220 shown In FIG. 2/3, and a glass insert, such as for example glass insert 215/225, to be installed therein according to one embodiment of the present disclosure. The body 214/224 is constructed from a polycarbonate substrate material 230. In the illustrated example, the substrate material 230 has a mirror coating 232 on an upper surface thereof (although it is to be understood that the mirror coating 232 may be omitted, and/or that other types of coatings may be applied, in other embodiments). The term "upper" and related directional terms used herein refer to the direction farther from a user's eye when the goggles are worn, and conversely "lower" and related terms refer to the direction closer to the user's eye. A portion of the substrate material 230 forms the lip 216/226 that protects the glass insert 215/225 and provides registration during assembly as discussed above.

Figure 4A:
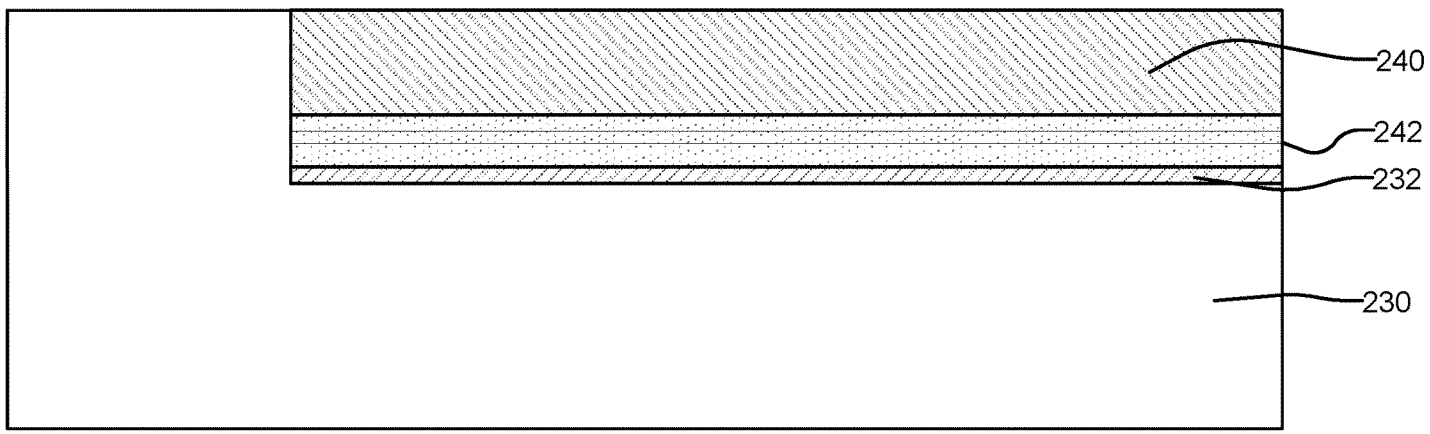
FIG. 4A shows the portion of the swimming goggle lens of FIG. 4 with the glass insert installed therein.

The glass insert 215/225 comprises a glass plate 240, with an adhesive sheet 242 on the underside thereof. In some embodiments, the adhesive sheet 242 comprises an AB silicone gel adhesive of the type used in certain smartphone screen protectors. AB silicone gel adhesive allows the glass inserts 215 and 225 to be manually installed without special tools or equipment. The inserts 215 and 225 can also be easily removed without leaving any residue or damage to the substrate. As discussed above, in some embodiments a removable protective cover 241 is provided on the upper side of the glass plate 240. FIG. 4A shows the portion of the swimming goggle lens of FIG. 4 with the glass insert installed therein, after the removable cover 241 has been removed.

As described below, in some embodiments the adhesive sheet 242 includes a layer of polyethylene terephthalate (PET) which provides shatter resistance, and prevents any glass shards from separating from the insert 215/225 if the glass is broken. Glass inserts configured for permanent installation in swimming goggles during polycarbonate molding, such as for example inserts 115/125 of the goggles of FIG. 1, may also include an adhesive sheet with a PET layer in some embodiments.

In some embodiments, the glass plate 240 comprises 0.40 mm aluminosilicate glass (9H hardness). In some embodiments, the adhesive sheet 242 comprises a 0.28 mm thickness AB silicone gel adhesive. In contrast to 0.18 mm thickness AB silicone gel adhesives commonly used in other applications, a sheet 242 having a greater thickness such as 0.28 mm provides better adhesion (wetting out) for substrates that have a looser flatness tolerance. For example, polycarbonate substrate materials typically used for making the goggle lenses have a flatness of about 10-20 μm, whereas glass typically has a flatness of less than 1 μm. A sheet 242 of 0.28 mm AB silicone gel adhesive also provides better impact resistance for the glass plate 240 (by absorbing more of the impact as compared to a thinner sheet).

In some embodiments, the adhesive sheet 242 comprises a plurality of layers. For example, in the FIG. 4 embodiment, the adhesive sheet 242 comprises an optically clear adhesive (OCA) layer 243 adhered to the glass plate 240, a polyethylene terephthalate (PET) layer 244 below the OCA layer 243, and a silicon gel layer 245 below the PET layer 244. In some embodiments, the glass insert has a total thickness of about 0.7 mm, and the body 214/224 of the cup/cap 210/220 has a corresponding 0.7 mm deep recess formed by the lip 216/226. In some embodiments, the lip 216/226 is approximately 0.9 mm wide. In some embodiments, the upper surface of the glass plate 240 has anti-fingerprint hydrophobic or oleophobic surface properties.

In other embodiments, the glass inserts may have different configurations. For example, in some embodiment the adhesive sheet 242 may comprise a 0.18 mm silicone gel adhesive. In some embodiments, glass inserts may be installed in goggles using a photocuring liquid adhesive as an alternative to the AB silicone gel adhesive, which would permanently bond the glass to the polycarbonate substrate.

In some embodiments, one or more additional glass panels may be provided for installation atop glass plate 240. For example, some embodiments may provide users with kits for installing glass panels with a variety of different mirror tints, colors, or other aftermarket glass profiles. In some such embodiments, the adhesive sheet under the additional glass panel is 0.18 mm thick, since the underlying material (the glass plate 240) would be very flat in comparison to the polycarbonate substrate.

Figure 5:
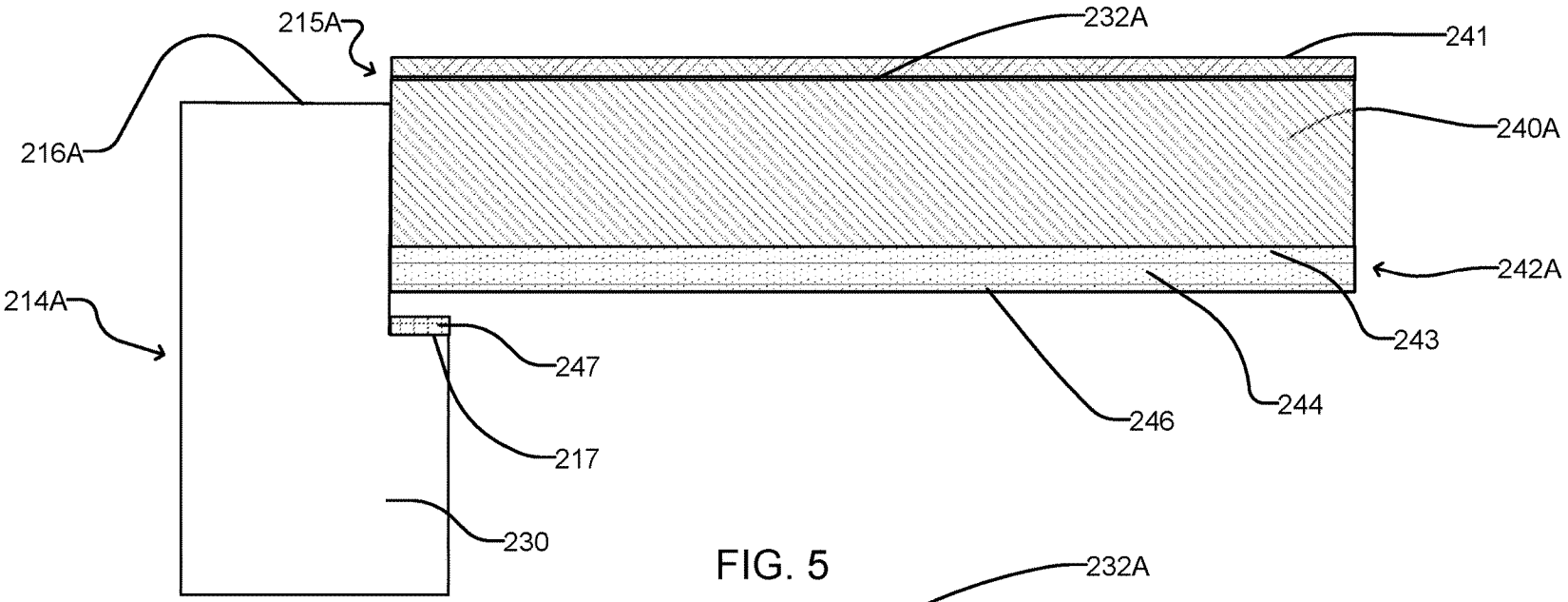
FIG. 5 shows a sectional view through portions of a swimming goggle lens and glass insert to be installed therein according to another embodiment of the present disclosure.
Figure 5A:
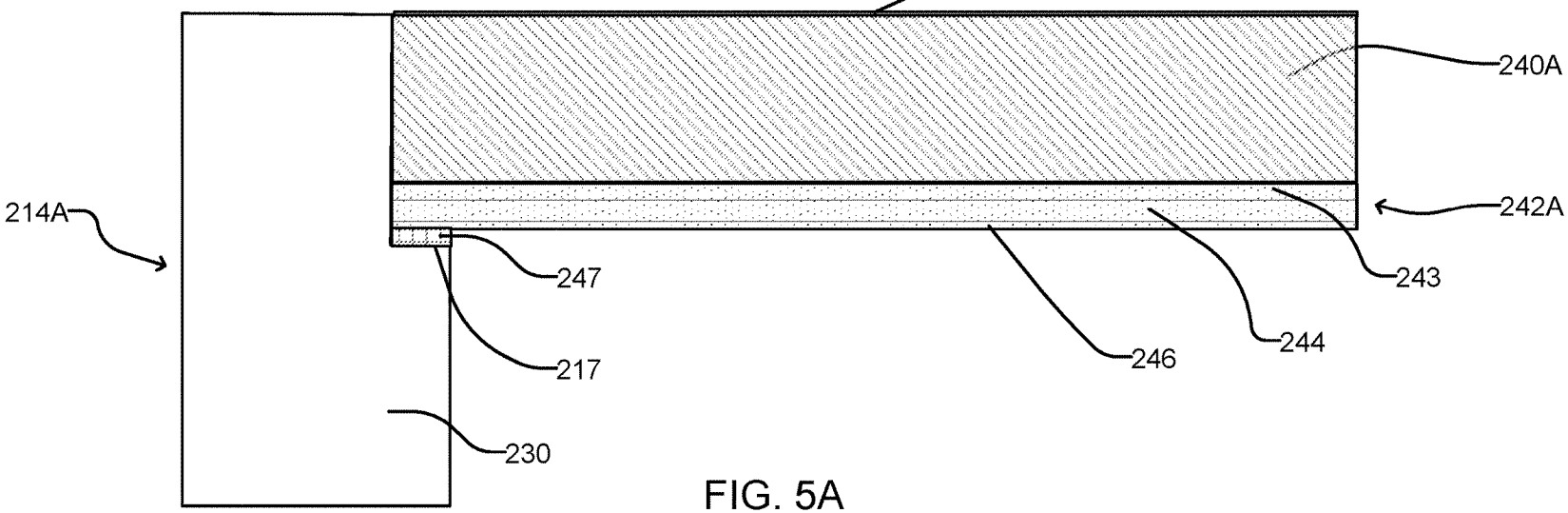
FIG. 5A shows the portion of the swimming goggle lens of FIG. 5 with the glass insert installed therein.

In some embodiments, a pair of goggles may be configured such that the polycarbonate material forming the body of the eyecup for each lens does not extend across the viewing portion, but instead provides a housing for receiving a glass insert, such as for example glass insert 215A as schematically illustrated in FIGS. 5 and 5A. Body 214A has an opening sized to receive glass insert 215A, and a ledge 217 is formed by the polycarbonate material 230 of body 214A around the inside perimeter of the opening to support the glass insert 215A. The portion of body 214A above the ledge 217 defines a lip 216A, which protects the edge of the glass as described above.

Glass insert 215A of FIGS. 5 and 5A is similar to insert 215 of FIGS. 4 and 4A, but comprises a thicker glass plate 240A, such as for example about 1.5 mm to 2.0 mm thick. A coating 232A (such as for example a mirror coating or other coating) may optionally be applied to the upper side of glass plate 240A. Glass insert 215A also comprises an adhesive sheet 242A with an OCA layer 243 and a PET layer 244, but without a silicon gel layer. Instead, an anti-fog coating 246 is applied to the bottom of PET layer 244 of glass insert 215A. A ring of liquid adhesive 247 is provided along the ledge 217 to secure the glass insert 215A to the body 214A.

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing implementation of the various example embodiments described herein.

The description provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As will be apparent to those skilled in the art in light of the foregoing disclosure, many alterations and modifications are possible to the methods and systems described herein. While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as may reasonably be inferred by one skilled in the art. The scope of the claims should not be limited by the embodiments set forth in the examples, but should be given the broadest interpretation consistent with the foregoing disclosure.

The present disclosure may be embodied in other specific forms without departing from its spirit or essential characteristics. The described embodiments are to be considered in all respects only as illustrative and not restrictive.

The invention claimed is:

1. A pair of swimming goggles comprising two goggle lenses, each goggle lens comprising a body constructed form a substrate material and a glass insert received within a lip extending upwardly from around a perimeter of the body, wherein the body of each goggle lens defines a recess configured to receive the glass insert, wherein the glass insert is installed on top of a coating applied to the substrate material of the goggle lens at a bottom of the recess, wherein the glass insert comprises a glass plate having an adhesive sheet on an underside thereof, and wherein the adhesive sheet comprises an optically clear adhesive (OCA) layer adhered to the glass plate, a polyethylene terephthalate (PET) layer under the OCA layer, and a silicon gel layer under the PET layer.

2. The pair of swimming goggles of claim 1 wherein the glass plate comprises a generally planar sheet of glass.

3. The pair of swimming goggles of claim 2 wherein the generally planar sheet of glass has a substantially uniform thickness.

4. The pair of swimming goggles of claim 1 wherein the glass plate comprises a curved sheet of glass.

5. The pair of swimming goggles of claim 1 wherein the glass insert comprises an anti-fingerprint coating on an upper surface thereof.

6. A method of making a pair of swimming goggles according to claim 1, comprising pressing each glass insert into the respective recess.

7. The method of claim 6 wherein each glass insert comprises a protective cover on an upper surface thereof, the method comprising removing the protective cover after pressing the glass insert into the respective recess.

8. A pair of swimming goggles comprising two goggle lenses, each goggle lens comprising a body constructed form a substrate material and a glass insert received within a lip extending upwardly from around a perimeter of the body, wherein the body of each goggle lens defines an opening configured to receive the glass insert and a ledge around an inner perimeter of the opening for supporting the glass insert, wherein the glass insert comprises a glass plate having an adhesive sheet on an underside thereof, and wherein the adhesive sheet comprises an optically clear adhesive (OCA) layer adhered to the glass plate and a polyethylene terephthalate (PET) layer under the OCA layer, with an anti-fog coating applied to an underside of the PET layer.

9. A pair of swimming goggles comprising two goggle lenses, each goggle lens comprising a body constructed form a substrate material and having a lip extending upwardly from around a perimeter of the body and defining a recess in the body, and having a coating applied to the substrate material of the goggle lens at a bottom of the recess, and a glass plate received in the recess and positioned on top of the coating, wherein the glass plate has an adhesive sheet on an underside thereof, and wherein the adhesive sheet comprises an optically clear adhesive (OCA) layer adhered to the glass plate, a polyethylene terephthalate (PET) layer under the OCA layer, and a silicon gel layer under the PET layer.

* * * * *